US006779553B1

(12) United States Patent
Heidger

(10) Patent No.: US 6,779,553 B1
(45) Date of Patent: Aug. 24, 2004

(54) EMERGENCY BACKFLOW SYSTEM

(76) Inventor: Michael A. Heidger, 1138 W. Lorain St., Appleton, WI (US) 54914

( * ) Notice: Subject to any disclaimer, the term of this patent is extended or adjusted under 35 U.S.C. 154(b) by 0 days.

(21) Appl. No.: 10/384,828

(22) Filed: Mar. 11, 2003

(51) Int. Cl.[7] ..... F16L 5/00; F16K 51/00

(52) U.S. Cl. ..... 137/362; 137/247.49; 137/247.41; 137/433; 137/247.23

(58) Field of Search ..... 137/362, 247.49, 137/247.23, 247.41

(56) References Cited

U.S. PATENT DOCUMENTS 1,088,066 A * 2/1914 Farley ..... 137/240
1,136,766 A * 4/1915 Bonneman ..... 137/240
1,323,718 A * 12/1919 Odenkirk ..... 137/247.41
1,498,885 A * 6/1924 Odenkirk ..... 137/247.41
1,608,929 A * 11/1926 Edelman ..... 137/247.41
2,431,640 A * 11/1947 Gordon ..... 137/115.02
3,229,707 A * 1/1966 Suchan ..... 137/236.1
3,874,403 A 4/1975 Fischer ..... 137/386
4,074,684 A * 2/1978 Biesel ..... 137/1
5,005,603 A 4/1991 Amundson et al. ..... 137/192
5,075,905 A 12/1991 Rutherford ..... 4/191
5,144,699 A 9/1992 Graham ..... 4/256
5,161,911 A 11/1992 Regan ..... 137/110
6,063,275 A 5/2000 Traylor ..... 138/30

* cited by examiner

*Primary Examiner*—A. Michael Chambers
(74) *Attorney, Agent, or Firm*—Donald R. Schoonover

(57) ABSTRACT

An emergency backflow system includes a drain bowl and a holding tank fluidically connected to a utility sewer line. The holding tank is connected to the sewer line via a drain line, and the drain line can be fluidically separated from the drain bowl by a conduit having a float ball therein. The holding tank has a large capacity relative to the drain bowl and thus can accommodate large overflow situations which would otherwise overwhelm the drain bowl.

2 Claims, 2 Drawing Sheets

EMERGENCY BACKFLOW SYSTEM

BACKGROUND OF THE INVENTION

1. Field of the Invention

The present invention relates to the general art of fluid systems, and to the particular field of emergency drain systems.

2. Discussion of the Related Art

Sewer water backing up into a building can be a great disaster. The water can do serious damage and may require total remodeling if an area used for living is damaged. Sewer backup can be the result of a variety of causes, but whatever the cause, the results can be devastating.

Accordingly, the art includes several systems for controlling such backflow. For example, some system include a drain bowl fluidically connected to a utility sewage conduit. While helpful, a drain bowl may have a very small capacity. As such, overflow may be quickly transferred, via the drain bowl, into a larger area. Thus, even if the backup is only limited, the drain bowl may not have capacity sufficient to accommodate even a limited backup. As such, the drain bowls may have limited usefulness. However, since drain bowls are generally built into a floor, such drain bowls cannot be overly large.

Therefore, there is a need for an emergency backflow system which has capacity sufficient to accommodate large backflows.

Still further, even though many presently-installed backflow systems are inadequate for large backflow volumes, these systems still have some capacity and should be utilized whenever possible. This will not only permit utilizing the advantages associated with presently-installed systems, it will save money and time by avoiding the need to remove such installed systems to upgrade the capacity of an emergency backflow system.

Therefore, there is a need for an emergency backflow system which can utilize a backflow system existing in a building.

Still further, there is a need for an emergency backflow system which will work in conjunction with an existing backflow system in order to enhance the effects of both systems.

PRINCIPAL OBJECTS OF THE INVENTION

It is a main object of the present invention to provide an emergency backflow system which has capacity sufficient to accommodate large backflows.

It is another object of the present invention to provide an emergency backflow system which can utilize a backflow system existing in a building.

It is another object of the present invention to provide an emergency backflow system which will work in conjunction with an existing backflow system.

SUMMARY OF THE INVENTION

These, and other, objects are achieved by an emergency backflow system which comprises a floor having a floor level located in a substantially horizontal plane; a utility sewer line which extends in a vertical plane through the floor; a drain line having a first end fluidically connected to the utility sewer line, a first portion located beneath the floor level, a second portion which extends in a vertical plane upwardly through the floor level, and an outlet end located above the floor level; a drain bowl located beneath the floor level; a first fluid conduit fluidically connecting the drain bowl to the drain line; a second fluid conduit which is oriented in a vertical plane and which extends vertically, the second fluid conduit including a first end fluidically connected to the drain bowl, a second end fluidically connected to the drain bowl, a floatable element located in the second fluid conduit and which is movable between the first end of the second fluid conduit and the second end of the second fluid conduit; a fluid holding tank supported on the floor above the floor level and which is fluidically connected to the outlet end of the drain line; and a vent fluid conduit fluidically connecting the holding tank to the utility drain.

The holding tank is thus fluidically inserted into the system and is capable of holding as much as thirty to fifty gallons or more of liquid. This holding tank thus holds overflow from the sewer line that might otherwise undesirably spill into a surrounding area, such as a residential basement. The flow control line between the drain bowl and the drain line allows the drain bowl to hold fluid in a normal manner, but will block off the drain bowl from overflow that is moving through the sewer line and from the sewer line to the drain line. Thus, fluid moving through the drain line will not spill upwardly into the drain bowl.

The emergency backflow system of the present invention is easily installed and can be easily retrofit into an existing system.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Figure 2:
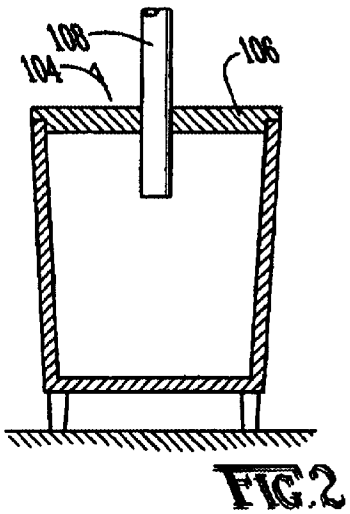
FIG. 2 is an elevational view taken along line 2—2 of FIG. 1.
Figure 1:
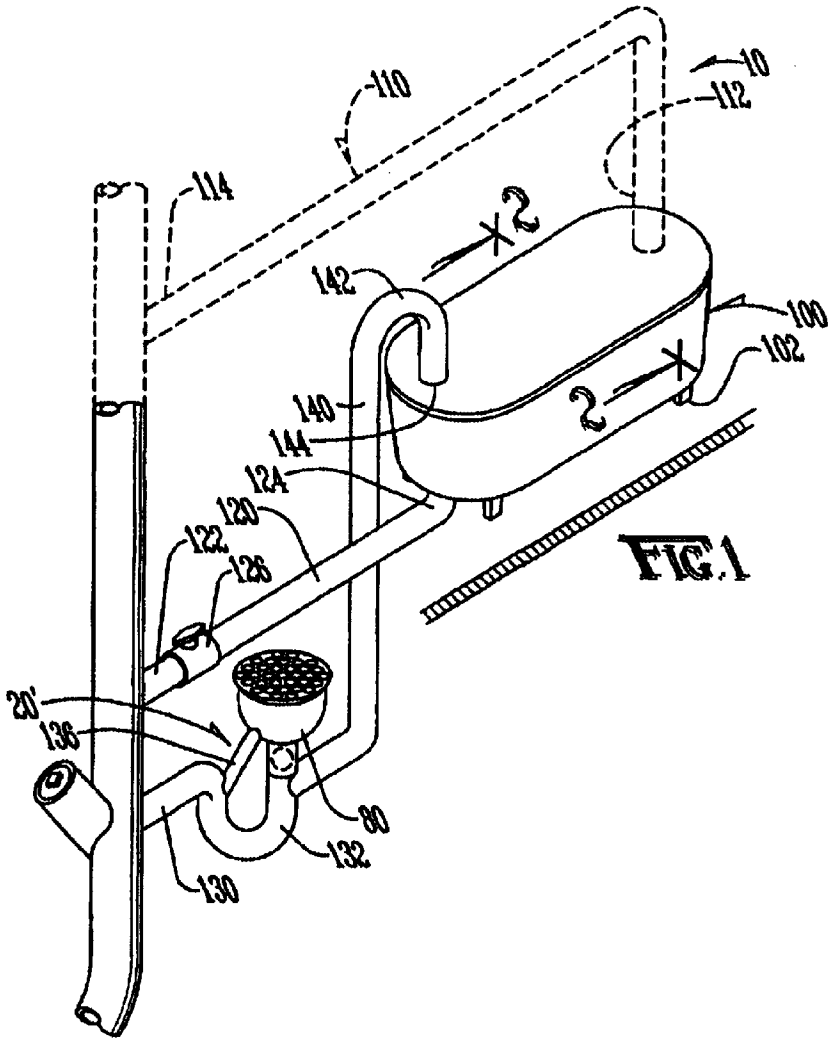
FIG. 1 is a perspective view of one form of the emergency backflow system embodying the present invention.
Figure 3:
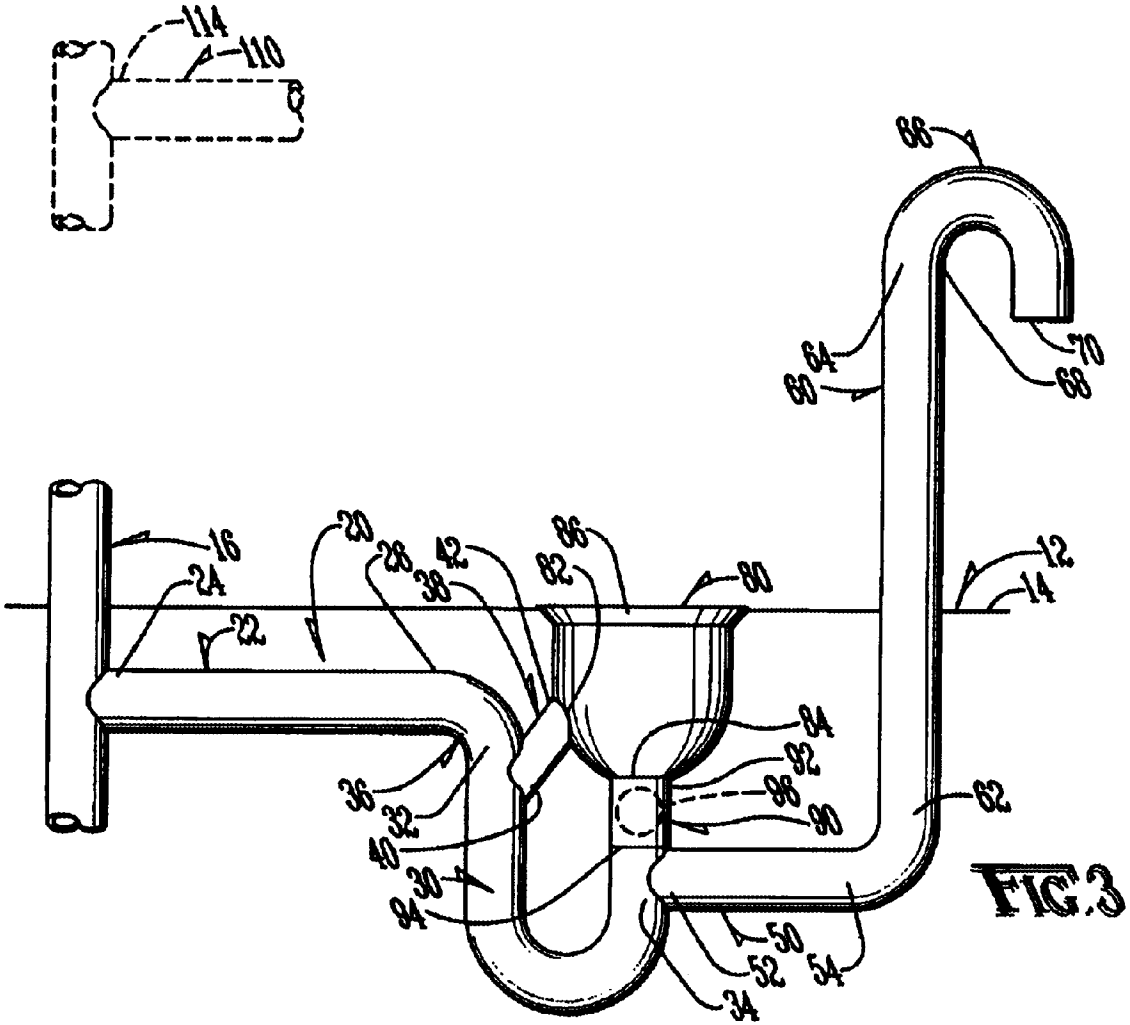
FIG. 3 is an elevational view showing a form of the emergency backflow system embodying the present invention.

As shown in FIGS. 1 and 3, the invention is embodied in an emergency backflow system 10. System 10 comprises a floor 12 having a floor level 14 located in a horizontal plane. A utility sewer line 16 extends through floor 12.

As best shown in FIG. 3, a drain line 20 includes a first linear portion 22 having a first end 24 fluidically connected to sewer line 16 beneath floor level 14. First linear portion 22 extends beneath the floor level 14 horizontally. A second end 26 of the first linear portion 22 is spaced apart from the first end 24 of the first linear portion 22 of the drain line 20. A first U-shaped portion 30 is located beneath the floor level 14 and extends in a vertically oriented plane. First U-shaped portion 30 has a first end 32 fluidically connected to the second end 26 of the first linear portion 22 of the drain line 20 and a second end 34 spaced apart from the first end 32 of the U-shaped portion 30. The fluid connection between the first end 32 of the first U-shaped portion 30 and the second end 34 of the first linear portion 22 of the drain line 20 forms a first fluid junction 36.

A second linear portion 38 of the drain line 20 has a first end 40 fluidically connected to the first U-shaped portion 30 of the drain line 20 at a location spaced apart from first fluid junction 36. The second linear portion 38 has a second end 42 spaced apart from the first fluid junction 36.

A third linear portion 50 of the drain line 20 extends beneath floor level 14 in a horizontal plane. Third linear portion 50 has a first end 52 fluidically connected to second end 34 of the first U-shaped portion 30 and a second end 54 spaced apart from first end 52 of the third linear portion 50.

A fourth linear portion 60 of the drain line 20 extends in a vertical plane through floor 12 from beneath floor level 14 to above the floor level 14. Fourth linear portion 60 has a first end 62 fluidically connected to second end 54 of the third linear portion 50 and a second end 64 spaced above the floor level 14 and spaced apart from the first end 62 of the fourth linear portion 60.

A second U-shaped portion 66 of the drain line 20 is located above the floor level 14 and has a first end 68 fluidically connected to second end 64 of fourth linear portion 60 and an outlet end 70 spaced apart from the first end 68. Outlet end 70 of the second U-shaped portion 66 is located above the floor level 14.

A drain bowl 80 is located beneath the floor level 14 and has a first fluid port 82 fluidically connected to second end 42 of second linear portion 38 of the drain line 20. The drain bowl 80 further includes a second fluid port 84 which is spaced apart from the first fluid port 82. The drain bowl 80 includes a top rim 86 which is positioned in a is horizontal plane and is located at the floor level 14. Drain bowl 80 has a one-half gallon capacity and is considered for the purposes of this disclosure as being pre-existing.

A flow control conduit 90 is oriented in a vertical plane beneath the floor level 14 and has a first end 92 fluidically connected to second fluid port 84 of the drain bowl 80 and a second end 94 fluidically connected to first end 52 of third linear portion 50 of the drain line 20. A float ball 96 is movably positioned in the flow control conduit 90 and is movable in a vertical direction between a first position (not shown in FIG. 3) occluding first end 92 of flow control conduit 90 and a second position (shown in FIG. 3 in solid lines) occluding second end 94 of the flow control conduit 90. The float ball 96 prevents fluid flowing in the drain line 20 from flowing into the drain bowl 80 and prevents fluid in the drain bowl 80 from flowing into the drain line 20. Thus, if there is a sudden surge of flow volume in the sewer line 16, the fluid will flow into drain line 20 and through U-shaped portion 30. The fluid will then push float ball 96 upwards closing off second fluid port 84, which then forces fluid through third linear portion 50 and up through fourth linear portion 60, then out through the outlet end 70 and into holding tank 100. The float ball 96 can also be connected to an alarm system that will alert a property owner or manager that fluid is flowing through the drain system and bypassing the drain bowl 80. The alarm can be visible or audible and can be local or remote.

System 10 further includes a holding tank 100 supported on the floor 12, such as by legs 102 or the like, and is located above the floor level 14. Holding tank 100 is fluidically connected to outlet end 70 of second U-shaped portion 66 of the drain line 20 and receives fluid therefrom. Holding tank 100 includes a cover 104 which is supported on a top rim 106 of the tank 100. A vent 108 extends through cover 104. A vent fluid conduit 110 is located above the floor level 14 and has a first end 112 fluidically connected to the vent 108 of the holding tank 100 and a second end 114 fluidically connected to the utility drain.

Holding tank 100 generally has a thirty to fifty gallon capacity and thus adds that capacity to the overflow accommodating feature of the drain bowl 80. This capacity will accommodate slight overflow of the sewer line 16.

An additional fluid conduit 120 is used in the form of the invention shown in FIG. 1. Fluid conduit 120 includes a first end 122 fluidically connected to sewer line 16 and a second end 124 fluidically connected to the holding tank 100. A shutoff valve 126 is located in conduit 120. A drain line 20' includes a first linear portion 130 fluidically connected to sewer line 16 and a first U-shaped portion 132 fluidically connected to first linear portion 130. First U-shaped portion 132 is also fluidically connected to drain bowl 80. First port 82 of the drain bowl 80 is fluidically connected to a linear portion 136 which is fluidically connected to first linear portion 130. A vertically-oriented portion 140 of the drain line 20 is fluidically connected to third linear portion 50 and a second U-shaped conduit 142 is fluidically connected to portion 140. An outlet end 144 of conduit 142 is fluidically connected to the inside of the holding tank 100 through cover 104. System 20' has fluid flowing from drain line 20', to the holding tank 100 via the drain bowl 80 rather than bypassing the drain bowl 80 as occurs in system 20 shown in FIG. 3.

It is understood that while certain forms of the present invention have been illustrated and described herein, it is not to be limited to the specific forms or arrangements of parts described and shown.

What is claimed and desired to be covered by Letters Patent is:

1. An emergency backflow system comprising:

a) a floor having a floor level located in a horizontal plane;

b) a utility sewer line which extends in a vertical plane through said floor;

c) a drain line having (1) a first end fluidically connected to said utility sewer line, (2) a first portion located beneath the floor level, (3) a second portion which extends in a vertical plane upwardly through the floor level, and (4) an outlet end located above the floor level;

d) a drain bowl located beneath the floor level;

e) a first fluid conduit fluidically connecting said drain bowl to said drain line;

f) a second fluid conduit which is oriented in a vertical plane and which extends vertically, said second fluid conduit including (1) a first end fluidically connected to said drain bowl, (2) a second end fluidically connected to said drain bowl, (3) a floatable element located in said second fluid conduit and which is movable between the first end of said second fluid conduit and the second end of said second fluid conduit;

g) a fluid holding tank supported on said floor above the floor level and being fluidically connected to the outlet end of said drain line; and h) a vent fluid conduit fluidically connecting said holding tank to said utility drain.

2. An emergency backflow system comprising:

a) a floor having a floor level located in a horizontal plane;

b) a utility sewer line which extends through said floor;

c) a drain line having (1) a first linear portion having (A) a first end fluidically connected to said sewer line beneath the floor level, the first linear portion of said drain line extending beneath the floor level horizontally, and (B) a second end spaced apart from the first end of the first linear portion of said drain line, (2) a first U-shaped portion located beneath the floor level and extending in a vertically oriented plane, the first U-shaped portion having a first end fluidically connected to the second end of the first linear portion of said drain line and a second end spaced apart from the first end of the U-shaped portion, the fluid connection between the first end of the first U-shaped portion and the second end of the first linear portion of said drain line forming a first fluid junction, (3) a second linear portion having a first end fluidically connected to the first U-shaped portion of said drain line at a location spaced apart from the first fluid junction, the second linear portion having a second end spaced apart from the first fluid junction, (4) a third linear portion extending beneath the floor level in a horizontal plane, the third linear portion having (A) a first end fluidically connected to the second end of the first U-shaped portion, and (B) a second end spaced apart from the first end of the third linear portion, (5) a fourth linear portion which extends in a vertical plane through said floor from beneath the floor level to above the floor level, the fourth linear portion having (A) a first end fluidically connected to the second end of the third linear portion, and (B) a second end spaced above the floor level and spaced apart from the first end of the fourth linear portion, and (6) a second U-shaped portion located above the floor level and having (A) a first end fluidically connected to the second end of the fourth linear portion, and (B) an outlet end spaced apart from the first end, the outlet end of the second U-shaped portion being located above the floor level;

d) a drain bowl located beneath the floor level and having (1) a first port fluidically connected to the second end of the second linear portion of said drain line, (2) a second fluid port spaced apart from the first fluid port, and (3) a top rim positioned in a horizontal plane and located at the floor level;

e) a flow control conduit oriented in a vertical plane beneath the floor level and having (1) a first end fluidically connected to the second port of said drain bowl, (2) a second end fluidically connected to the first end of the third linear portion of said drain line, (3) a float ball movably positioned in said flow control conduit to be movable in a vertical direction between a first position occluding the first end of said flow control conduit and a second position occluding the second end of said flow control conduit;

e) a holding tank supported on said floor and located above the floor level, said holding tank being fluidically connected to the outlet end of the second U-shaped portion of said drain line, said holding tank including (1) a cover, and (2) a vent through the cover of said holding tank; and g) a vent fluid conduit being located above the floor level and having (1) a first end fluidically connected to the vent of said holding tank, and (2) a second end fluidically connected to said utility drain.

* * * * *